United States Patent [19]

Julius

[11] Patent Number: 4,836,228

[45] Date of Patent: Jun. 6, 1989

[54] CONTAINER CLEANING APPARATUS

[75] Inventor: Richard F. Julius, Silver Spring, Md.

[73] Assignee: S. J. Industries, Inc., Alexandria, Va.

[21] Appl. No.: 938,436

[22] Filed: Dec. 5, 1986

[51] Int. Cl.[4] ..... B08B 3/02

[52] U.S. Cl. ..... 134/72; 134/131

[58] Field of Search ..... 134/61, 63, 72, 70, 134/71, 51, 131, 126

[56] References Cited

U.S. PATENT DOCUMENTS

| | | | |
|---|---|---|---|
| 1,943,775 | 1/1934 | Taylor | 134/72 |
| 3,018,200 | 1/1962 | Huddle | 134/72 |
| 3,024,795 | 3/1962 | Roller et al. | 134/61 |
| 3,289,682 | 12/1966 | Naslund | 134/131 |
| 3,411,518 | 11/1968 | Fisher et al. | 134/72 |
| 3,640,508 | 2/1972 | Reibig | 366/116 |
| 3,902,512 | 9/1975 | Armstrong et al. | 134/61 |
| 3,938,533 | 2/1976 | Richard | 134/63 |
| 4,231,806 | 11/1980 | Henry | 134/72 |
| 4,313,451 | 2/1982 | Vilen | 134/72 |
| 4,550,622 | 11/1985 | La Bonte et al. | 366/116 |

FOREIGN PATENT DOCUMENTS

| | | | |
|---|---|---|---|
| 1239738 | 7/1960 | France | 134/61 |

*Primary Examiner*—Harvey C. Hornsby
*Assistant Examiner*—Joseph S. Machuga
*Attorney, Agent, or Firm*—Michael W. York

[57] ABSTRACT

Container cleaning apparatus including an endless conveyor to transport the containers being cleaned through the apparatus. The container cleaning apparatus uses both high and low pressure liquid to clean the containers. The high pressure liquid is projected on the containers in a pattern that cleans the containers but does not hinder their progress on the conveyor. An agitating system is also provided that agitates the cleaned containers in a vertical direction to assist in removing liquid and drying the containers. The containers are also subjected to an air blast as they are being agitated that assists in causing evaporation of the liquid on the containers.

2 Claims, 1 Drawing Sheet

FLOW
F

CONTAINER CLEANING APPARATUS

BACKGROUND OF THE INVENTION

Containers such as those commonly called cases are used in many industries. For instance, cases are used by the food, beverage, baking and other industries to deliver products such as in bottles or the like to stores and other types of customers. These cases are of a returnable type and are reused many times. The cases become dirty and for sanitary reasons are frequently washed in some manner after a number of uses. These cases are primarily made of plastic material and extensively ribbed to strengthen the case and yet permit the case to be manufactured with the minimum use of plastic.

There are existing case washers in the marketplace. However, these present case washers have a number of deficiencies. To wash the cases effectively, the present case washers use heated water and/or chemical agents. Heated water usage is expensive and not highly effective in dirt removal. The addition of chemical agents is also expensive and increases the necessary manual supervision time and adds to the complexity of the process because of the need to control the entry and exit of the chemical effluent.

It is also desirable to remove water from the cases before exiting from the case washer or cleaning apparatus. Present drying systems associated with a container cleaning apparatus use fan air circulation to remove excess water from the cases. Because of the pockets on the cases due to the extensive ribbing on the cases, the circulating air drying is deficient and does not thoroughly result in the liquid being removed from the surface of the cases.

The present invention avoids the use of hot water and/or chemicals and yet thoroughly cleans the cases. In addition, it greatly overcomes the drying deficiency and resulting effective removal of liquid from the surface of the container being cleaned including containers such as cases with irregular surfaces caused by extensive ribbing and the like.

SUMMARY OF THE INVENTION

This invention relates to a container cleaning apparatus and more particularly to a container cleaning apparatus that utilizes a pressurized fluid.

Accordingly, it is a primary object of the invention to provide a container cleaning apparatus that thoroughly cleans containers.

It is also an object of the invention to provide a container cleaning apparatus that efficiently cleans the containers.

It is an object of the invention to provide a container cleaning apparatus that is particularly useful in cleaning reusable containers.

It is an object of the invention to provide a container cleaning apparatus that is particularly useful in cleaning containers made of a plastic material.

It is an object of the invention to provide a container cleaning apparatus that does not require the use of large quantities of hot water and/or chemicals to effectively clean containers.

It is an object of the invention to provide a container cleaning apparatus that requires minimal supervision as it is cleaning containers.

It is an object of the invention to provide a container cleaning apparatus in which the containers are subjected to both a low and a high pressure fluid spray.

It is an object of the invention to provide a container cleaning apparatus tht utilizes separate wash and rinse portions.

It is an object of the invention to provide a container cleaning apparatus in which the wash fluid is kept substantially separate from the rinse fluid.

It is another object of the invention to provide a container cleaning apparatus that uses a highly efficient high pressure fluid spray pattern.

It is another object of the invention to provide a container cleaning apparatus that also efficiently dries the containers after they are washed.

It is an object of the invention to provide a container cleaning apparatus in which the containers are subjected to an evaporation drying process.

It is an object of the invention to provide a container cleaning apparatus in which the containers are subjected to an additional drying process as well as evaporation.

It is an object of the invention to provide a container cleaning apparatus in which the containers are agitated in order to remove fluid from the surface of the containers.

It is an object of the invention to provide a container cleaning apparatus that effectively removes fluid from pockets and the like on the surface of the containers during the process of drying the containers.

It is also an object of the invention to provide a container cleaning apparatus that is capable of cleaning a large volume of containers or a large number of containers in a short period of time.

The present invention provides a container cleaning apparatus including container transporting means for transporting containers along a predetermined path and both high and low pressure liquid spray as the containers as traveling along the predetermined path while being transported by the container transporting means. The container cleaning apparatus also includes means for drying the containers comprising means for agitating the containers to remove liquid from the outside surface of the containers.

BRIEF DESCRIPTION OF THE DRAWINGS

The invention will be hereinafter more fully described with reference to the accompanying drawings in which.

DETAILED DESCRIPTION OF THE PREFERRED EMBODIMENTS

Figures 1, 2, 3, 4, 5, 6:
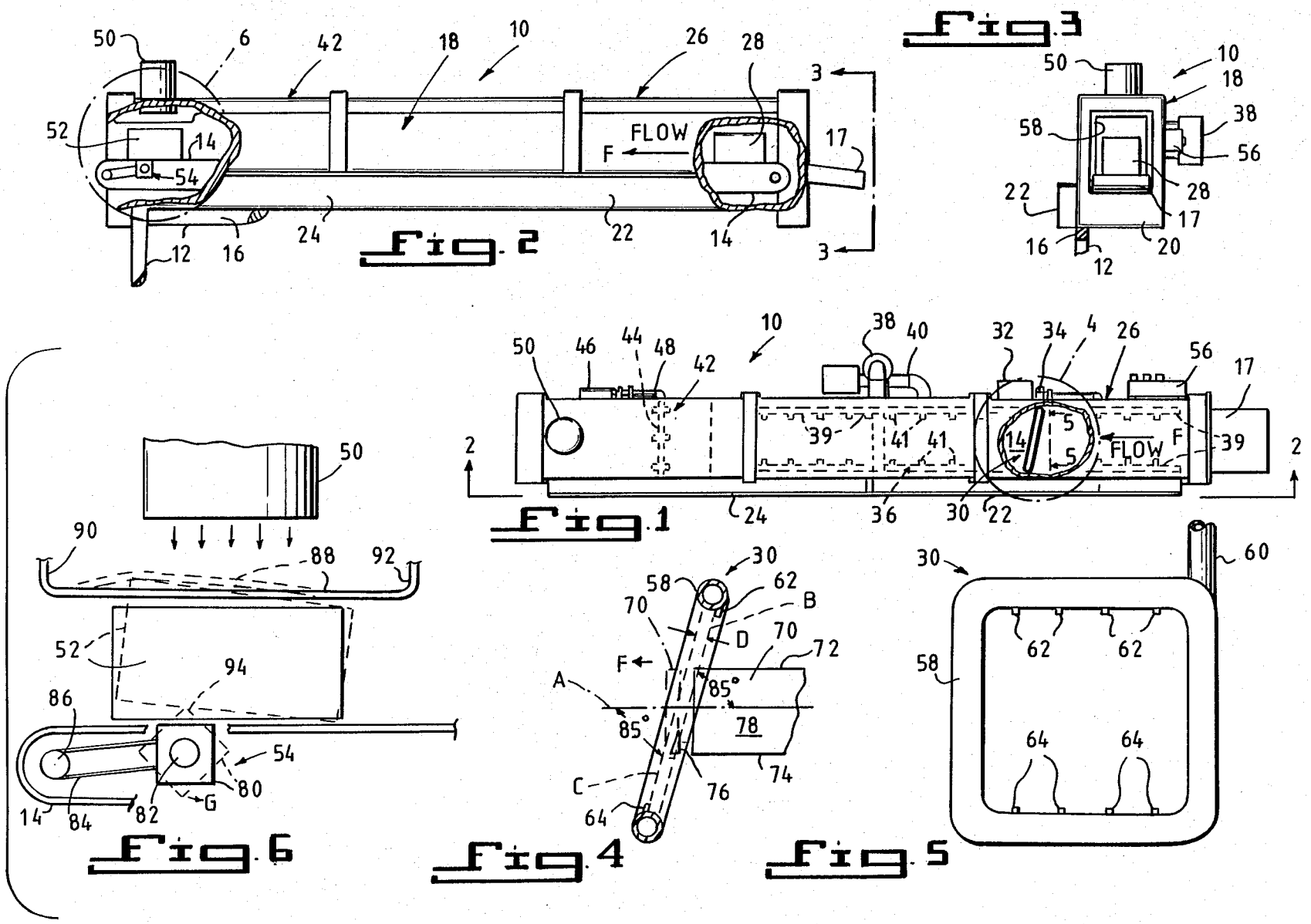
FIG. 1 is a top plan view of the container cleaning apparatus invention with certain parts broken away for clarity.
FIG. 2 is a front elevational view of the structure illustrated in FIG. 1 taken in the direction of the line 2—2 thereof with certain portions broken away for clarity.
FIG. 3 is an end elevational view of the structure illustrated in FIGS. 1 and 2 taken in the direction of the line 3—3 of FIG. 2.
FIG. 4 is an enlarged view of a portion of the structure illustrated in FIGS. 1 and 2 taken within the circle 4 of FIG. 1 with a portion broken away.
FIG. 5 is an enlarged view of a portion of the structure illustrated in FIG. 1 taken in the direction illustrated by the line 5—5 thereof.
FIG. 6 is an enlarged view of a portion of the structure illustrated in FIGS. 1 through 3 taken within the circle 6 of FIG. 2.

Referring first to FIGS. 1, 2, and 3 of the drawings the container cleaning apparatus of the invention is illustrated and is designated generally by the number 10. The container cleaning apparatus 10 comprises a cleaning apparatus support structure or stand 12 that is constructed in a conventional manner and an elongated conventional endless belt conveyor 14 that is connected to the upper portion 16 of the support stand 12 in a conventional manner. A conventional infeed converyor 17 is illustrated that is used to feed the main conveyor 14 in a conventional manner. The container cleaning apparatus 10 also comprises an elongated hollow generally rectangular shaped enclosure 18 that extends over the upper portion of the conveyor 14 whose lower portion 20 is connected in a conventional manner to the upper portion 16 of the support stand 12 and separate wash and rinse fluid recovery tanks that are designated respectively by the numbers 22 and 24 and are connected in a conventional manner to the upper portion 16 of the support stand 12.

As illustrated in FIGS. 1, 2, and 3, the container cleaning apparatus 10 has a forward cleaning portion 26 that includes means for spraying containers such as the container 28 with high pressure fluid comprising high pressure erosion fluid spray apparatus designated by the number 30 that is located within the forward cleaning end portion 26 of the enclosure 18 immediately adajcent the endless belt conveyor 14. The high pressure fluid spray apparatus 30 is connected to a source of high pressure fluid comprising the high pressure fluid pump 32 that is in fluid communication with the high pressure fluid spray apparatus 30 via the hollow fluid conduit 34.

The forward cleaning portion 26 also includes means for spraying containers such as the container 28 with low pressure cleaning fluid such as water comprising low pressure fluid spray apparatus designated by the number 36 that is in fluid communication with a low pressure fluid pump 38 by the conduit 40. The low pressure fluid spray apparatus 36 is conventional in nature and comprises a hollow manifold that has portions thereof 39 that run lengthwise within the enclosure 18. The portions 39 have nozzles 41 located at predetermined intervals that are in fluid communication with the manifold portion 39 in order to spray the containers such as the container 28 as they pass on the conveyor 14 within the enclosure 18.

The endless belt conveyor 14 conveys the container that is to be cleaned such as the container designated by the number 28 through the cleaning end portion 26 in a conventional manner and into the rinse and drying portion of the container cleaning apparatus that is designated by the number 42. The rinse and drying portion 42 includes a conventional low pressure rinse system that includes low pressure rinse fluid spray apparatus 44 that is connected to a conventional source of fluid 46 by the fluid conduit 48. Since the low pressure rinse fluid spray apparatus 44 is conventional in nature and is known in the art it is not described in detail.

After the container, such as the container designated by the number 28, is exposed to rinse fluid from the rinse fluid spray apparatus 44 it is conveyed by the conveyor 14 to a position under means for providing air for assisting in drying containers comprising air blower apparatus 50 that is located on top of the enclosure 18 in the rinse and drying portion 42 so that it directs a stream of air downward and over the container such as the container 52 to assist in evaporating any fluid such as water that may remain on the surface of the container 52. Located below the blower apparatus 50 is means for separating fluid from the surface of containers such as the container 52 by overcoming the surface tension of the fluid on the containers comprising means of agitating said containers designated generally by the number 54 that subjects the containers, such as the container 52, to agitating movement in a generally vertical direction. The agitating means 54 will be hereinafter described in detail. The conveyor 14 is controlled by a conventional control box 56 that is illustrated in FIG. 1.

FIGS. 4 and 5 illustrate in greater detail the high pressure fluid spray apparatus 30. The high pressure fluid spray apparatus 30 comprises a generally rectangular hollow ring shaped manifold 58 that has a hollow inlet portion 60 through which fluid such as water passes into the interior of the manifold 58 from the fluid conduit 34. As illustrated in FIG. 4, the manifold 58 lies in substantially a vertical plane but the plane is canted or makes an acute angle with the long axis of the conveyor 14 that is represented by the letter A. The manifold 58 has a series of erosion nozzles 62 located on the right side of the manifold 58 when viewed in the direction F that the conveyor 14 moves and another similar series of erosion nozzles 64 located opposite the nozzles 62 on the left side of the manifold 58.

The important relationships of the nozzles 62 and 64, the manifold 58 and the long axis A of the conveyor 14 are best illustrated in FIG. 4. As illustrated in FIG. 4, the series of nozzles 62 emit a substantially flat fluid spray that lies substantially in the vertical plane that is designated by the letter B. In a similar manner the nozzles 64 emit a substantially flat fluid spray that also lies substantially in the vertical plane that is designated by the letter C. As illustrated, both the planes represented by the letters B and C make an angle of substantially eighty-five degrees with the long axis of the conveyor represented by the letter A.

It is important to note that the planes represented by the letters B and C are separated by a distance designated by the letter D. It has been determined that this distance D and the previously described angular relationship of the planes B and C with the axis A are very important for the proper functioning of the invention. The proper value for the distance designated D will depend upon the size of the containers, such as the containers designated 70 that are to be cleaned by the container cleaning apparatus 10.

In view of the angular relationship of the planes represented by the letters B and C and the distance D, the container, such as the container 70, that approaches and then moves into the area of the manifold 58 the container 70 is first struck by or enters into and is impacted upon by the fluid spray from the nozzles 62 that lie substantially in the plane B. In view of the angular relationship of the plane B with the long axis A of the conveyor 14 that also obviously is substantially the same as the direction of travel of the containers being cleaned, such as the container 70, the fluid spray from the nozzles 62 exerts a force against the container side 72 that pushes the container 70 in the direction that it is moving and hence this assists in moving the container 70.

The front of the container, such as the container 70, as indicated by the phantom lines, wil then come into contact with the fluid spray from the nozzles 64 so that the front of the container 70 is cleaned. This does not occur until the container 70 travels the distance D and this is important since the container 70 is subjected to the forward force from the fluid from the spray nozzle 62 prior to receiving the rearward force from the fluid spray from the nozzles 64. If this did not occur then the rearward force from the fluid spray nozzles 64 that lies in the plane C could stop or hinder movement of the container 70 being cleaned.

As the container 70 continues to move its right or other side 74 is subjected to the fluid spray from the nozzles 64. As movement of the container 70 continues its rear surface 76 is subjected to the fluid spray from the nozzles 62. It should also be noted that the spray from both the nozzles 62 and 64 cleans the top 78 of the container 70.

The container, such as the container 70, continues its movement through the container cleaning apparatus 10 in view of the moving conveyor 14 and are subjected to the rinse spray from the conventional rinse spray apparatus 44. The containers then move by action of the moving conveyor 44 to a position under the air dryer 50 where as indicated by the container 52 the containers are subjected to agitation by the agitating means 54 as indicated in detail in FIG. 6. As indicated in FIG. 6, the container agitating means 54 comprises a generally rectangular spaced member 80 when viewed from the side that is rigidly connected to a rotating shaft 82 that extends through the control portion of the rectangular shaped member 80.

Both the shaft 82 and the rectangular shaped member 80 are caused to rotate in the direction G due to the belt 84 that interconnects the shaft 82 and the conveyor shaft 86. The direction of rotation G is counterclockwise or in the direction of movement of the conveyor 14. This is important since jamming of the container cleaning apparatus 10 or damage to the containers, such as the container 52, could otherwise result. In the preferred embodiment the rectangular shaped member is made from a suitable plastic to prevent damage to the container 52.

As illustrated in FIG. 6, an elongated resilient member 88 is located above the rotating rectangular shaped member 80 at a height that is just sufficient to provide clearance for the passage of the containers, such as the container 52, as they are moved along by the conveyor 14. The elongated resilient member 88 is connected in tension between two rigid fixed supports 90 and 92 that in turn are suitably connected in a conventional manner to the upper portion of the enclosure 18. The exterior of the resilient member 88 is coated with a suitable plastic to prevent damage to the containers, such as the container 52, and in the preferred embodiment the resilient member 88 comprises a section of plastic coated steel aircraft control cable.

As indicated in FIG. 6, when the container 52 is moved into the vicinity of the rotating rectangular shaped member 80 it is struck on its underside by one of the corners, such as the corner 94 of the rotating rectangular member 80. This causes the container to be moved or projected in an upward direction, as indicated by the phantom lines, so that the upper portion of the container 52 strikes the resilient member 88 to push it upward, as indicated by the phantom lines. The corner then continues to rotate and then the resilient member 88 exerts a downward force on the container 52 to push it downward. This up and down movement or agitation of the container 52 causes the surface tension of drops of fluid such as water on the container to be overcome so that the fluid is shaken from the surface of the container. In the preferred embodiment the rectangular shaped member 80 is sized so that each container 52 is struck at least twice by the corners, such as the corner 94, of the rectangular shaped member 80.

The container cleaning apparatus 10 is made and used in the following manner. The basic portions of the container cleaning apparatus 10 that are conventional in nature including the stand 12, the endless belt conveyor 14, the enclosure 18 and the fluid recovery tanks 22 and 24 are constructed in a conventional manner using suitable metal such as stainless steel and in the case of the enclosure 18 a suitable plastic for portions of the enclosure 18. In a similar manner, the low pressure fluid spray apparatus 36, the pump 38, and the conduit 40 are conventional in nature and are fabricated from suitable materials such as stainless steel or in the case of the pump are purchased. The same is true for the low pressure rinse fluid spray apparatus 44, the source of fluid 46 and the assocaited conduit 48. The air blower apparatus 50 is also conventional and is readily available from numerous suppliers. The infeed conveyor 17 and the control box 56 are also conventional in nature and can be readily constructed or obtained in a conventional manner.

The manifold 58 of the high pressure fluid spray apparatus 30 can be constructed of suitable stainless steel tubing by bending, welding and drilling and tapping in a manner well known to those skilled in the art and the drilling and tapping will allow the nozzles 62 and 64 to be suitably threaded into place. The nozzles that can be used for the nozzles 62 and 64 are obtainable from Spraying Systems of Wheaton, Ill. and are known as flat jet nozzles. The pump 32 that should be used with the high pressure fluid spray apparatus 30 is a centrifugal pump that is obtainable from Aurora Pump Company, Aurora, Ill. The high pressure conduit 34 can be made of a portion of suitable high pressure fluid conduit that is known in the art. As previously indicated, in constructing and emplacing the high pressure fluid spray apparatus 30, it is important that it be located to provide the relationships with the planes B and C, the axis A, and the distance D indicated in FIG. 4.

The pressure of the fluid, such as water, as it exits the nozzles 62 and 64 should be between about 50 pounds per square inch (psi) and about 125 psi and in the preferred embodiment it should be between about 75 psi and about 100 psi. This high pressure is necessary to obtain erosion of the dirt on the surface of the containers, such as the containers 28 and 52 that are being cleaned when the fluid exits the nozzles 62 and 64 and strikes the containers 28 and 52.

As indicated previously, the rectangular shaped member 80 should be made from or at least coated with plastic and this can be accomplished in a manner known to those skilled in the art. The rectangular shaped member 80 can be secured to the shaft 82 in a suitable manner such as through the use of conventional fasteners (not shown) that are known in the art and the shaft 82 can be suitably rotatably supported by conventional bearings (not shown). The belt 84 is conventional as in the manner of locating it around the shafts 82 and 86. As previously indicated, the resilient member 88 can be made from plastic coated aircraft control cable or the like with its ends suitably secured in a conventional manner to the rigid steel supports 90 and 92 that are connected in a conventional manner to the top of the enclosure 18.

The container cleaning apparatus 10 is used in the following manner. The endless conveyor 14 is activated using the control box 56 that causes a motor (not shown) to drive the conveyor 14. The control box 56 is also used to activate the pump or fluid supply means 32, 38 and 46 and the blower 50 through suitable connections known in the art that are not shown. The fluid supply means 32, 38 and 46 are connected to a suitable source of fluid supply through suitable means (not shown). The fluid recovery tanks 22 and 24 will be connected to suitable drains and possibly adapted for recirculation of the fluid through suitable means known in the art that are not shown.

The container cleaning apparatus 10 is then ready to clean containers such as the containers 28 and 52. A container to be cleaned, such as the container 28, is placed upon the upper surface of the feed conveyor 17 that is activated by suitable means (not shown) that are known in the art. The conveyor 17 feeds the container 28 to the main conveyor 14 which then feeds or transports the container 28 through the low pressure fluid spray apparatus 36 and the high pressure fluid spray apparatus 30 that functions in the previously described manner. The containers, such as the container 28, are cleaned by the combination of the low and high pressure fluid apparatus 36 and 30. The high pressure fluid such as water from the high pressure fluid spray apparatus 30 actually erodes away hard to remove dirt and the like from the container 28.

The conveyor 14 then transports the container that is being cleaned such as the container 28 or 52 to the rinse fluid spray apparatus 44 where loose dirt and the like is removed from the container by rinsing. Then the conveyor 14 transports the container being cleaned, such as the container 52, to a position under the air dryer 50 where it is subjected to a blast of air and also to the action of the container agitating means 54. Both the air from the air dryer 50 and the agitating means 54 tend to dry the container 52. The dryer 50 tends to dry the container 52 through evaporation and blowing th fluid off, buth the agitating means 54 acts differently since it physically separates liquid from the surface of the container 52 as a result of inertia of the fluid on the surface of the container 52 that tends to remain in place as the container is moved slowly upward or downward in generally a vertical direction. As a result of this the surface tension that the liquid on the surface of the container has is overcome so that the liquid is separated from the surface of the container. The cleaned and dried container is then transported to the exit end of the conveyor 14 where it can be received by another conveyor or the like (not shown).

Although the invention has been described in considerable detail with reference to a certain preferred embodiment, it will be understood that variations or modifications may be made within the spirit and scope of the invention as defined in the appended claims.

What is claimed is:

1. Container cleaning apparatus for cleaning containers having a long axis comprising means for transporting said containers along a predetermined path in the direction of said long axis, spraying means associated with said container transporting means for subjecting said containers to a fluid spray during at least a portion of the time said containers are being transported by said transporting means comprising means for subjecting said containers to a high pressure fluid spray and means for subjecting said containers to a lower pressure fluid spary, said high pressure fluid spray means comprising a manifold, a first series of nozzles located on said manifold for emitting a substantially flat fluid spray with the flat fluid spray lying substantially in a plane to exert a force against said container being cleaned that pushes said container in the direction said container is moving and a second series of nozzles located on said manifold for emitting a substantially flat fluid spray with the flat fluid spray lying substantially in a plane to exert a rearward force against said container being cleaned with the nozzles of said first and second series of nozzles being located in order that the planes of the substantially flat fluid sprays are separated and substantially parallel and form angular relationships of less than ninety degrees with the long axis of said container transporting means with the first series of nozzles located to cause the fluid from the nozzles to push against the container being cleaned prior to the fluid from the second series of nozzles whereby said first series of nozzles causes a pushing force to be exerted on said container by fluid in the direction said container is moving prior to said rearward fluid force being applied from said second series of nozzles.

2. Container cleaning apparatus for cleaning container having a long axis comprising means for transporting said containers along a predetermined path in the direction of said long axis, spraying means associated with said container transporting means for subjecting said containers to a fluid spray during at least a portion of the time said containers are being transported by said transporting means comprising means for subjecting said containers to a high pressure fluid spray and means for subjecting said containers to a lower pressure fluid spray, said high pressure fluid spray means comprising a manifold, first fluid spray means for causing fluid spray to exert a force against said container being cleaned that pushes said container in the direction said container is moving and second fluid spray means for causing fluid spray to exert a rearward force against said container being cleaned located with respect to said container being cleaned to cause fluid spray from said first fluid spray means for causing a pushing force in the direction said container is moving to exert said pushing force against said container being cleaned prior to said second fluid spray means exerting said rearward force, said first fluid spray means for causing fluid spray to exert a force against said container that pushes said container in the direction said container is moving and said second fluid spray means for causing fluid spray to exert a rearward force against said container each comprising a series of nozzles located on said manifold for emitting a substantially flat fluid spray with the flat fluid spray lying substantially in a plane and wherein said planes are separated from each other by a distance with the planes forming angular relationships of less than ninety degrees with the long axis of said container transporting means and means associated with said container transporting means for drying at least a portion of said containers during at least a portion of the time said containers are being transported by said container transporting means comprising means for blowing a fluid over the surface of said containers to cause fluid to evaporate from the surface of said container and means for subjecting said container to movement in a generally vertical direction to agitate said containers and overcome the surface tension of the fluid on said containers to physically separate fluid from the surface of said containers comprising a rotatable member having means for striking said containers and projecting said containers in an upward direction and a resilient member for exerting a downward force on said containers.

* * * * *